United States Patent [19]

Tominaga

[11] 4,314,860

[45] Feb. 9, 1982

[54] METHOD FOR DIRECT HEAT TREATING HOT ROLLED STEEL WIRE ROD

[75] Inventor: Jiro Tominaga, Hikari, Japan

[73] Assignee: Nippon Steel Corporation, Tokyo, Japan

[21] Appl. No.: 184,324

[22] Filed: Sep. 5, 1980

[30] Foreign Application Priority Data

Sep. 6, 1979 [JP] Japan ..... 54-113562
Sep. 7, 1979 [JP] Japan ..... 54-114894
Sep. 10, 1979 [JP] Japan ..... 54-115938

[51] Int. Cl.[3] ..... C21D 9/52
[52] U.S. Cl. ..... 148/12 B
[58] Field of Search ..... 148/12 B, 12 R

[56] References Cited

U.S. PATENT DOCUMENTS 3,231,432 1/1966 McLean et al. ..... 148/12 B
3,645,805 2/1972 Hoffmann et al. ..... 148/12 B
3,783,043 1/1974 Almond et al. ..... 148/12 B

*Primary Examiner*—W. Stallard
*Attorney, Agent, or Firm*—Wenderoth, Lind & Ponack

[57] ABSTRACT

Method for heat treating hot rolled steel wire rod in direct sequence with the final finishing stand of a rod hot rolling mill which comprises a series of steps of subjecting the rod emerging from the rolling mill to a direct controlled cooling in the range of Ms to 550° C. by utilizing the retained heat of the rod, and subsequently reheating it to a temperature as equal as the nose temperature of TTT diagram with a view to achieving the complete transformation to the sorbite structure, whereby a wire rod product having the mechanical properties equal to those of a rod resulting from the lead patenting process can be obtained.

6 Claims, 4 Drawing Figures

METHOD FOR DIRECT HEAT TREATING HOT ROLLED STEEL WIRE ROD

BACKGROUND OF THE INVENTION

1. Field of the Invention

The present invention relates to a method for direct heat treating a steel wire rod, more particularly, to a method for direct heat treating a hot rolled wire rod in direct sequence with the final finishing stand of a hot rolling mill by utilizing the retained heat of the hot rolled rod.

2. Description of the Prior Art

The conventional high carbon steel wire rods produced by the hot rolling mill has been subjected to air-patenting (referred to AP hereinafter) or lead-patenting (referred to LP hereinafter) prior to the wire drawing step with a view to enhancing its drawability, tensile strength and toughness.

Recently the direct heat treatment of the hot rolled rod wherein the retained heat of the rod as it emerges from the final finishing stand of the hot rolling mill is fully utilized (referred to DP hereinafter) has been carried out. As is well known, the LP wire rod has a high strength as well as high toughness, its metallurgical structure is completely transformed to sorbite, and further it is considerably superior in uniformity along the whole length thereof. In accordance with miscellaneous method of DP of prior art heretofore carried out or proposed, the rod quality as equal as that resulting from AP can be attained. However, the rod quality equal to that of LP has never been achieved yet.

In order to obtain the strength and toughness of a rod equal to those of LP by the DP process, a cooling rate after hot rolling, particularly, cooling below $Ar_1$ is most important, and a controlled cooling to a pertinent temperature should be effected at a pertinent cooling rate of 10°–100° C./sec. depending on the grade, type, and size of steel rod.

If the controlled cooling described above is effected immediately after the final finishing stand of the hot rolling mill or soon after the cooling guide pipe, however, it has been found that the rod quality equal to that obtained from LP is not achieved by the conventional DP process because the microstructure of the rod after the controlled cooling is not uniform due to the difference of temperature, which will be mentioned hereinafter and which lies in the directions of both section and length of the rod prior to the controlled cooling.

To eliminate the difference of structure of the rod after the controlled cooling, it is required that the temperature of the rod should be uniform along its length as the controlled cooling starts at a temperature above $Ar_1$. Japan Patent Publication No. SHO45-23215(1970), Japan Patent Publication No. SHO46-19767(1971), and Japan Open-Laid Patent No. SHO53-149,811(1978) have all disclosed how to attempt the maintenance of the rod temperature along its temperature above $Ar_1$ as one inventive idea, respectively. The Japan Patent Publication No. SHO45-23215(1970) makes an attempt to keep the rod temperature as uniform as possible by subjecting the hot rolled rod traveling on a reeler after hot rolling to the spray cooling of multiple stage type. However, the temperature difference of the rod before it is reeled is so large that it amounts as much as 10%, and it is difficult for the maintenance of uniform temperature, particularly where the high speed rolling line prevails in recent days.

Besides, although the uniform temperature of the rod can be attained before it is reeled, it is feared that the difference of temperature may occur at the start of controlled cooling after reeling. Japan Patent Publication No. SHO46-19767(1971) and Japan Open-Laid Patent No. SHO53-149,811(1978) disclose that both attempt to prompt the growth of austenite crystal grain by holding or heating the rod in the austenite zone, and it is required to heat the rod at a relatively higher temperature than $Ar_1$, and particularly, at a temperature of above $A_3+50°$ C. in the disclosure of Japan Patent Publication No. SHO46-19767(1971), hence it causes excessive scale and also disadvantage in a descaling step, and further, it causes the degraded surface of the rod.

SUMMARY OF THE INVENTION

Accordingly, it is an object of the invention to provide a method for direct heat treating a hot rolled wire rod or DP method by which the rod quality as equal as that obtained from LP or lead-patenting can be achieved.

It is another object of the invention to provide a direct heat treating method in which a hot rolled steel rod at a high temperature emerging from the final finishing stand of a rod hot rolling mill is subjected to a controlled cooling by utilizing the retained heat of the rod with a view to achieving a rod quality as equal as that obtained from LP or lead patenting.

It is an additional object of the invention to provide a direct heat treating method of heat cycle for a hot rolled rod in which the rod still at a high temperature issuing from the hot rolling mill is subjected to a controlled cooling by utilizing its retained heat, and subsequently it is reheated, whereby the rod whose quality being equal to that of LP can be obtained.

It is a still further object of the invention to provide a direct heat treating method of such a heat cycle as that wherein a hot rolled rod still at a high temperature is held at a temperature immediately above $Ar_1$ by utilizing its retained heat, then subjected to controlled cooling, and subsequently reheated, whereby the rod quality equal to that of LP can be achieved.

BRIEF DESCRIPTION OF THE DRAWINGS

The present invention will be better understood with reference to the accompanying drawings which illustrate an embodiment of the invention, in which.

DETAILED DESCRIPTION OF THE INVENTION

This invention is directed to a method for direct heat treating a hot rolled wire rod still at a high temperature emerging from hot rolling in which the rod is subjected to controlled cooling at a cooling rate to a temperature not below Ms in order to obtain the sorbite structure, and subsequently to reheating to a temperature as equal as the nose temperature of TTT (time temperature transformation) diagram of the rod so as to hold at a temperature for a sufficiently long period of time to secure the complete transformation of untransformed austenite structure to a sorbite structure.

Figure 1:
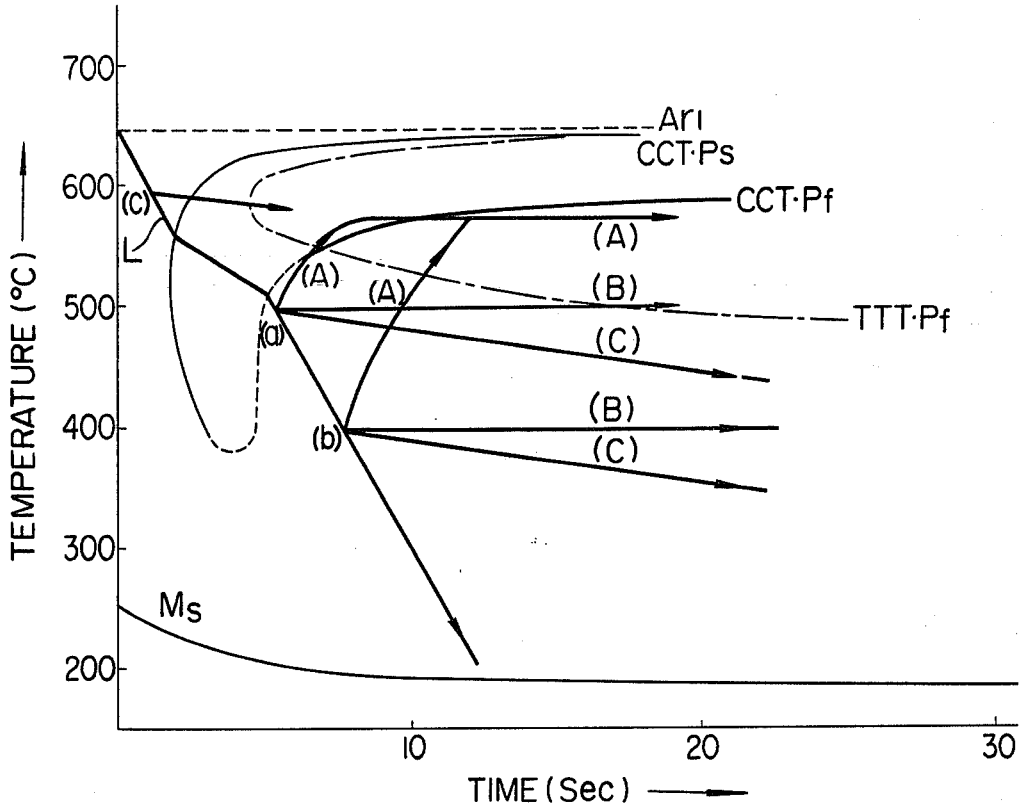
FIG. 1 is an explanatory view of the invention showing transformation cooling diagrams.

Referring more particularly to FIG. 1, the transformation diagram of SWRH (steel wire rod hard) 82B is shown together with cooling curves. In order to obtain a rod of the same quality as that of LP, it is very important to subject the rod to controlled cooling to a temperature lower than $Ar_1$. For example, it is required that the rod should be cooled along the line L and the nose of CCT (continuous cooling transformation) diagram should be traversed. However, if there is any fluctuation or variation in the cooling step up to $Ar_1$, a considerable difference of time before traversing the nose of CCT diagram occurs at some portions of the rod. Therefore, if we attempt to render every portion of the rod to traverse the nose, it follows that there occurs a phenomenon "super-cooling" at the part of low temperature of the rod. Hence the rod having a quality as equal as that of LP cannot be obtained from the super-cooled rod.

If we attempt to avoid such super-cooling, the portion of the rod at high temperature, for instance, as indicated at C point, will not traverse the nose, and result in the formation of a coarse pearlite structure transformed at high temperature. Thus the strength equal to that of LP is not to be expected.

In accordance with the method of invention, the wire rod whose quality being equal to that of LP can be easily manufactured by the process which comprises transforming an untransformed austenite to a fine sorbite structure at the nose temperature of TTT diagram indicated in Curve A for a relatively short period of time, although it is not subjected to a relatively severe controlled cooling of the former stage in the practical processing line.

In the controlled cooling of the former stage of FIG. 1, diagram of SWRH82B, although the rod may be cooled very carefully, and the cooling may be ceased above Ms, it cannot be expected to obtain the rod having a quality as equal as that of LP the formation of martensite. For instance, when the cooling is ceased at B point (400° C.), the rod cannot be cooled to traverse the Pf line of TTT diagram, though it is air-cooled (C) or it is held (B) as such. In case the cooling is ceased at (a) point, (500° C.) and the rod is held the temperature, it is required about 20 seconds after $Ar_1$ to traverse TTT diagram Pf, and if air-cooled it will not apply to Pf.

It follows from the above, the direct heat treating method of this invention comprises the steps of heat treating the rod in such manner that it traverses the nose of CCT diagram over the whole section and along the whole length of the rod, and subsequently reheating the rod to traverse TTT diagram Pf and hold it at a temperature (570° C. in FIG. 1) which corresponds to the nose temperature of TTT diagram to achieve the complete transformation of untransformed austenite to sorbite.

In FIG. 1, when the highest temperature part of the rod traverses the nose of CCT diagram to reach (a) point, the controlled cooling ceases, and even though, at this time, the lowest temperature part is super-cooled to reach (b) point, both traverse TTT diagram Pf together by reheating as shown in Curve (A), which causes the complete transformation to sorbite.

The controlled cooling rate depends on the grade and diameter of rod, and it is preferred that 45° C. per second for the rod of 5.5 mmϕ, 30° C. per second for 9 mmϕ, and 20° C. per second for 13 mmϕ in the steel rod, SWRH82B.

The controlled cooling may be ceased in the period longer than the time during which the highest temperature part of the rod traverses the nose of CCT diagram and shorter than the lowest temperature part reaches Ms. As it depends on the chemical composition of the rod and its size, it can be previously determined. In SWRH82B, the time after $Ar_1$ is 5–12 seconds for the rod of 5.5 mmϕ, 7–19 seconds for 9 mmϕ, and 9–29 seconds for 13 mmϕ. However, the time should be preferred shorter, because it takes much time for reheating if it is super-cooled. A holding time for the rod at a temperature equal to the nose temperature of TTT diagram depends on its size, and more than 10 seconds suffice.

As fully described in the foregoing, it is usual to obtain the sorbite structure equal to that resulting from LP by reheating the rod to a temperature corresponding to the nose temperature of TTT diagram. However, it is sometimes feared that when the highest temperature part of the rod traverses the nose temperature of CCT diagram the lowest temperature part lowers below Ms depending on the grade and chemical composition of the rod and its size or reduction schedule of hot rolling.

For example, there is such a case as in reaching $Ar_1$ the variation or fluctuation within the rod is great or the nose of CCT diagram is pretty wide. According to the experiment conducted by the inventors of the invention, in reaching $Ar_1$, if the temperature variation within the rod amounts to more than 200° C., holding the rod at a temperature immediately above $Ar_1$ is required. In these cases, it is most appropriate for the practice to render the rod temperature to be uniform in the directions of both section and length by holding it at a temperature immediately above $Ar_1$. But it is not required to hold the rod at that temperature, when the temperature variation within the rod lies in less than 200° C. or preferably less than 100° C. as the rod's temperature reached $Ar_1$.

The above holding treatment is carried out as follows: a temperature holding zone is provided along the conveyor on which continuous rod ring in non-concentric overlapping form travels, and the rod ring is held at the holding zone at a controlled temperature. According as the holding temperature lowers less than $Ar_1$, the transformation of austenite to ferrite+pearlite proceeds during this period, hence the sorbite structure we have in view is never developed. Furthermore, if the holding temperature rises much higher than $Ar_1$, the difference of temperature within the rod occurs again till it reaches $Ar_1$, therefore the object of this invention cannot be attained. Thus, $Ar_1+50°$ C. is preferred to be the upper limit.

The holding time depends on the heat transfer or conductivity of the rod, and it is determined according to the diameter of the rod as follows: more than 3 seconds for the rod of 5.5 mmϕ, more than 5 seconds for 9 mmϕ, and more than 7 seconds for 13 mmϕ.

Figure 2:
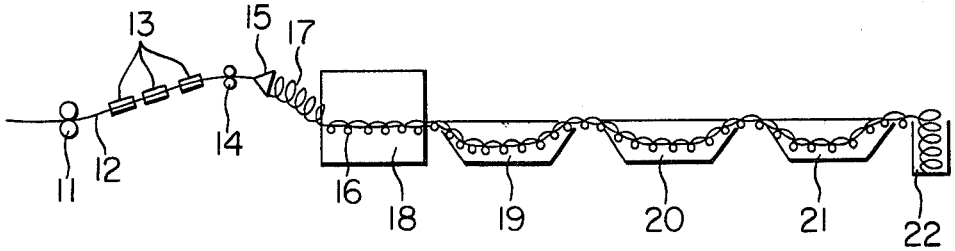
FIG. 2 is a schematic view of the invention for carrying out the embodiment.

Now, the method of this invention will be fully described with reference to the diagrammatic train of means shown in FIG. 2.

Wire rod 12 at the temperature of about 1000° C. emerging from the final finishing stand 11 of a hot rolling mill is water-cooled to a temperature above $Ar_1$ for several seconds through a cooling guide pipe 13, and it is deposited on a conveyor 16 in the form of a succession of non-concentric overlapping loose circular convolutions 17 via a pinch roll 14 and a laying reel or cone 15. At this time the wire rod 12 is quenched for so short a time that the temperature variation or fluctuation in the directions of section and length is so large that there occurs the difference of temperature of about 100°-300° C. Further, since there are overlapped and non-overlapped portions of the non-concentric rod rings on the conveyor, the difference of temperature also occurs between them.

The above difference of temperature on the conveyor occurs in case the rod is not water-cooled in the cooling guide pipe. If the controlled cooling should start in the above condition where there is the difference of temperature for the purpose of achieving the rod quality as equal as that obtained from LP, the aim, that is, the rod quality equal to that of LP cannot be attained, because the progress of transformation of structure deviates in some part of the rod and the variation of structure also occurs.

Therefore, while the loose non-concentric coil 17 of rod is being transported on the conveyor 16, the rod 17 is rendered to pass a holding furnace 18 so as to attain the uniform temperature of the rod 17 equal to a temperature immediately above $Ar_1$ over the whole part of the rod including section and length. Any kind or type of a holding furnace 18 may be used, such as, a furnace consisting of hood and heater provided on the conveyor 16 or a salt both apparatus, etc. As long as it can hold the rod at a certain temperature, any furnace is preferred. It is to be noted, however, that if the holding temperature lowers less than $Ar_1$, the transformation of austenite to ferrite+pearlite proceeds, hence the sorbite temperature in view cannot be attained.

Besides, if the temperature rises much higher than $Ar_1$, in the subsequent controlled cooling process, the difference of temperature occurs again till the rod passes $Ar_1$, hence the aim also cannot be attained, and further scale forms considerably. It affects the descaling operation in the next step, and the rod surface is also deteriorated, therefore it is desirable to hold the rod at a temperature in the range of $Ar_1$-$Ar_1$+50° C. As regards the holding time, it is described hereinbefore.

After having rendered the rod temperature to a temperature immediately above $Ar_1$, it is immersed in a salt bath 19 of low temperature to subject to the controlled cooling at a cooling rate determined by the grade and size of steel rod.

The reasons why the salt bath is used are as follows: 1. Because the salt bath temperature is held as more than Ms, martensite is never developed by traversing Ms even though the cooling time might be extended too long; and 2. Cooling rate equal to that of LP can be obtained from the immersion of a bath at a temperature higher than Ms.

In the pressurized air-water spray quenching and water spray quenching, if the rod is cooled at a rate as equal as that of LP, it is so difficult to assuredly cease the cooling step above Ms that martensite is developed.

The cooling rate aimed at attaining the sorbite structure corresponding to that of LP depends on the grade and size of the rod, and it is as described hereinbefore. In order to attain the above cooling rate in the salt bath 19, a salt of greater heat conductivity, such as, of nitrate should be used, and the rod is dipped in a salt of much lower temperature than that of the lead bath of the known LP treatment. The temperature of salt is preferred to be higher than Ms, but lower than 550° C. If the rod is immersed in the salt bath of a lower temperature than Ms, it is feared that martensite may be formed. On the contrary, however, if a higher temperature than 550° C., the sorbite structure our aim cannot be attained because the cooling rate is rather slow for the grade and size of rod we have in view. Furthermore, if the salt is stirred in the salt bath of low temperature, the cooling rate in view can be much more easily attained.

Figure 3:
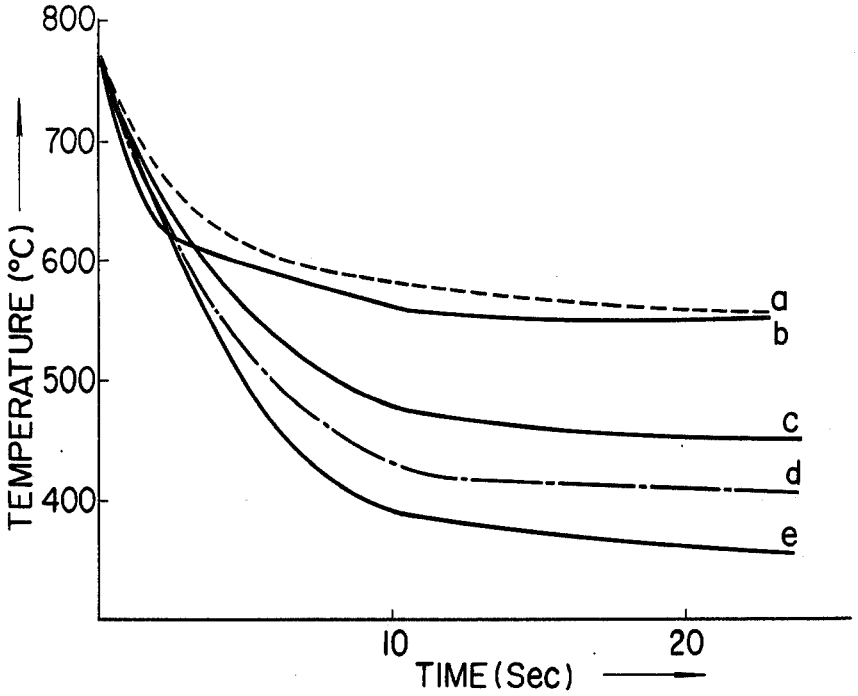
FIG. 3 is a diagram for showing the comparison of cooling rate between that of the heat treating method of the invention and that of LP or lead patenting.

As an example, FIG. 3 shows the cooling diagram of a rod, 5.5 mmϕ of SWRH62B at 750° C. as it is dipped in a molten bath of sodium nitrate as compared with the lead (Pb) bath. In FIG. 3, graph a shows the salt of 550° C., b the lead (Pb) bath of 550° C., c the salt of 450° C.; d 400° C., and e 350° C., respectively.

Table 1 shows the average cooling rate immediately before the start of pearlite transformation in connection with the rods of 5.5 mmϕ and 13 mmϕ of the same grade of steel.

TABLE 1

| | Bath Temperature | (C.°/S) 5.5 mmϕ | 13 mmϕ |
|---|---|---|---|
| Salt | 550° C. | 46 | 16 |
| | 450 | 60 | 22 |
| | 400 | 73 | 25 |
| | 350 | 80 | 32 |
| Pb | 550 | 80 | 28 |

From Table 1 and FIG. 3, it is found that the cooling rate as equal as that of LP can be obtained from the immersion of the rod in the salt bath. After the rod has been immersed in the salt bath 19 of low temperature, it is again dipped in a salt bath 20 of high temperature. As mentioned before, at the stage where the sorbite structure is developed by dipping the rod in the salt bath 19 of low temperature and cooling it at a desired cooling rate, the untransformed austenite still remains. The rod as such is dipped in the salt bath of low temperature for an extended period of time for the purpose of securing the complete transformation, but no martensite is developed, instead the bainite structure forms in that part so that the rod whose quality being equal to that of LP cannot be achieved.

However, although the rod whose quality as near as that of LP might be obtained, the total length of a production line would increase so long that it would be economically disadvantageous, because an extended period of time for immersion is required. Accordingly, the rod is dipped in the salt bath 19 of low temperature to cool at a desired rate so as to traverse the nose temperature of CCT diagram, thereafter again dipped in the salt bath 20 of high temperature to reheat to a temperature equal to the nose temperature of TTT diagram in order to achieve the complete transformation of untransformed austenite for a period of short time with the result that the whole sorbite structure is attained. The temperature of the salt bath of high temperature is preferred to be a temperature as equal as that of the nose of TTT diagram, and it is in the range of 500°-600° C. depending on the chemical analysis of steel of the rod. The holding time depends on the heat conductivity of the rod, so it also depends on the diameter of the rod. It is preferred to be more than 10 seconds. It is suitable for this treatment to dip the rod in a molten salt bath, for it must be heated to a high temperature for a period of very short time to traverse TTT diagram Pf, yet it must not be super-heated. If a gas-fired furnace, a resistance heating furnace, and the like is used, it takes so much time to raise the temperature or it may be so super-heated that the structure we have in view cannot be attained. Therefore it is not desirable.

After the rod has left the salt bath 20, it is plunged into a washing tank 21 to wash and remove an attached salt. Having secured the complete transformation in the salt bath 20 of high temperature, the rod may be freely cooled, for there is no possibility of formation of martensite. However, if left with salt attached, it gives rise to the formation of rust and occurrence of corrosion. Thus it is subjected to washing and also to reclaiming salt. Washing and cleaning are carried by spraying water onto the rod upwardly and downwardly on the transport roller, and by the combined use of a washtub 21 and water spray in addition to the immersion of the rod into the washtub 21 as shown in FIG. 2. The thus washed and cleaned rod is collected in a collection tub 22.

Examples are described hereinbelow.

Figure 4:
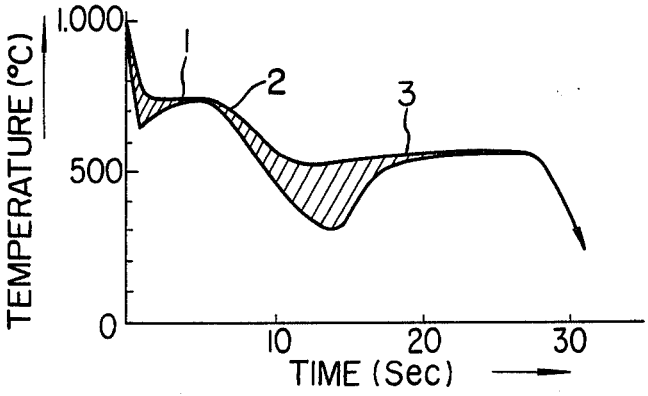
FIG. 4 is a sketch for showing a heat cycle of the heat treating method in accordance with the embodiment of the invention.

Results of various heat treatments listed in Table 3 and conducted on hard wire rods, 5.5–12.7 mmϕ, SWRH62B, 72B and 82B with chemical analysis shown in Table 2 are illustrated in Table 4 and Table 5. A heat treatment pattern D of this invention is indicated in FIG. 4 showing the shaded part as the range of variations or fluctuations between local portions of the rod, holding 1 immediately above $Ar_1$, controlled cooling 2, and holding 3 of the nose of TTT diagram, respectively.

TABLE 2

| Grade of Steel | SPECIMEN (% by wt.) C | Si | Mn | P | S |
|---|---|---|---|---|---|
| SWRH62B | 0.63 | 0.25 | 0.48 | 0.015 | 0.009 |
| SWRH72B | 0.72 | 0.28 | 0.81 | 0.018 | 0.012 |
| SWRH82B | 0.81 | 0.29 | 0.79 | 0.013 | 0.008 |

TABLE 3

| | Heat Treatment Pattern: Heat Treatment Pattern | Hold above $Ar_1$ | Controlled Cooling | Isothermal Transformation Hold |
|---|---|---|---|---|
| A | (DP of prior art) | Not performed | Performed | Not performed |
| B | (Example of Comparison) | Performed | Performed | Not performed |
| C | (Example of Comparison) | Not performed (temp. difference 200° C.) | Performed | Performed |
| $D_1$ | (This invention) | Not performed (temp. difference 100° C.) | Performed | Performed |
| $D_2$ | (This invention) | Performed | Performed | Performed |

TABLE 4

| Steel Grade | Size (mm) | Cooling Lowest Limit (°C.) | Isothermal Transformation Temp. (°C.) | Isothermal Transformation Time (Sec.) | Ultimate Tensile Strength (kg/mm²) | Reduction of area (%) | Remarks |
|---|---|---|---|---|---|---|---|
| SWR | 5.5ϕ | 400 | 550 | 15 | 107–115 | 50–59 | * |
| H62A | | 400 | — | — | 100–117 | 35–50 | *1 |
| | | LP | | | 108–113 | 51–58 | |
| SWR | 5.5ϕ | 400 | 550 | 15 | 126–134 | 42–47 | * |
| H82B | | 400 | — | — | 100–129 | 0–43 | *1 |
| | | 500 | — | — | 124–135 | 35–47 | *2 |
| | | LP | | | 125–133 | 42–49 | |
| SWR | 13ϕ | 400 | 550 | 20 | 120–127 | 36–45 | * |
| H82B | | 400 | — | — | 115–130 | 25–40 | *2 |
| | | LP compared rod | | | 119–125 | 37–45 | |

Remarks:
* Sorbite structure according to this invention
*1 Presence of mixed martensite structure
*2 Presence of some mixed martensite structure

TABLE 5

| Steel grade (SWR) | Size mm ϕ | Pattern | Mechanical Properties . Structure: Ultimate tensile strength kg/mm² X̄ | R | Reduction of area X̄ | R | Structure |
|---|---|---|---|---|---|---|---|
| | | A | 105 | 33 | 30 | 35 | variation for each specimen, such as, pearlite, sorbite, and martensite |
| | | B | 113 | 12 | 54 | 15 | mainly, sorbite mixed micromartensite and bainite |
| H62A | 5.5 | C | 109 | 14 | 50 | 18 | variation for each specimen, such as, tempered martensite, pearlite and sorbite |
| | | $D_1$ | 111 | 9 | 52 | 10 | mainly, sorbite, some variation |
| | | $D_2$ | 111 | 7 | 54 | 6 | mainly, sorbite |
| | | LP | 109 | 5 | 55 | 7 | mainly, sorbite |
| | | A | 109 | 32 | 31 | 45 | variation, such as, pearlite, sorbite and martensite |
| | | B | 118 | 15 | 50 | 20 | mainly, sorbite, much micromartensite |
| H72B | 5.5 | C | 121 | 15 | 48 | 17 | variation, such as, pearlite, sorbite and tempered martensite |
| | | $D_1$ | 122 | 8 | 51 | 11 | mainly, sorbite, some variation |
| | | $D_2$ | 123 | 5 | 53 | 7 | mainly, sorbite |

TABLE 5-continued

| Steel grade (SWR) | Size mm φ | Pattern | Mechanical Properties . Structure: Ultimate tensile strength kg/mm² X̄ | R | Reduction of area X̄ | R | Structure |
|---|---|---|---|---|---|---|---|
| | | LP | 122 | 6 | 52 | 7 | mainly, sorbite |
| | | A | 103 | 38 | 25 | 40 | variation, such as, pearlite, sorbite, and martensite |
| | | B | 124 | 21 | 35 | 28 | mainly, sorbite, including micromartensite |
| H82B | 13 | C | 120 | 23 | 34 | 22 | variation, such as, pearlite, sorbite, and tempered martensite |
| | | $D_1$ | 122 | 9 | 39 | 10 | mainly sorbite, some variation |
| | | $D_2$ | 123 | 7 | 41 | 9 | mainly, sorbite |
| | | LP | 122 | 6 | 39 | 7 | mainly, sorbite |

As clearly shown in Tables 4 and 5, the rod whose quality being as equal as that obtained from the conventional LP treatment can be attained from the embodiments, $D_1$ and $D_2$ patterns of this invention. Martensite is mixed in the rod of B pattern in which holding at the nose temperature of TTT diagram is not performed, hence the rod quality as same as that of LP treatment cannot be obtained. Furthermore, the structure of A pattern in which holding at the nose temperature of TTT diagram is not carried out consists of varied mixture of pearlite, sorbite, and martensite, and besides, there is much fluctuation or variation among many parts of the rod.

Although the present invention has been described and schematically illustrated in connection with preferred embodiments, it is to be understood that modifications may be restored to without departing from the spirit of the invention. Such modifications are considered to be within the scope of the present invention as defined by the appended claims.

What is claimed is:

1. Method for direct heat treating a hot rolled steel wire rod in direct sequence with the final finishing stand of a rod hot rolling mill which comprises a series of steps consisting of subjecting said rod to a controlled cooling at such a temperature as not below Ms at a cooling rate so as to form the sorbite structure in said rod by utilizing the retained heat of said rod as it emerges from the final stand of said hot rolling mill, reheating said rod to a temperature substantially equal to the nose temperature of TTT or time temperature transformation diagram of said rod, and holding said rod at said temperature for a period of sufficiently extended time to secure substantially complete transformation of untransformed austenite to the sorbite structure.

2. Method as claimed in claim 1 which comprises a series of steps consisting of subjecting said rod to said controlled cooling to the temperature of Ms to 550° C. at said cooling rate so as to form said sorbite structure in said rod by utilizing the retained heat of said rod as it emerges from the final stand of the hot rolling mill, and subsequently reheating said rod to a temperature in the range of 500°-600° C.

3. Method as claimed in claim 1 in which said controlled cooling is carried out at a temperature in the range determined by such a period of time as more than a period of time during which the highest temperature part of said hot rolled rod traverses the nose of CCT or continuous cooling transformation diagram and less than a period of time during which the lowest temperature part of said hot rolled rod reaches Ms.

4. Method as claimed in claim 1 in which the difference between highest and lowest temperatures of said hot rolled rod in said controlled cooling lies in less than 200° C.

5. Method as claimed in claim 1 in which said hot rolled rod is held at a temperature in the range of $Ar_1$ to $Ar_1+50°$ C. by utilizing the retained heat of said hot rolled rod.

6. Method as claimed in claim 1 which comprises a series of steps consisting of leading said hot rolled rod into a holding furnace to hold said rod at a temperature in the range of $Ar_1$ to $Ar_1+50°$ C., leading said rod into a salt bath which holds a temperature in the range of Ms to 550° C. to subject to controlled cooling, leading said rod into a salt bath which holds a temperature in the range of 500° C. to 600° C. in order to reheat said, and finally washing said rod.

* * * * *